United States Patent [19]

Phillips

[11] 4,431,046

[45] Feb. 14, 1984

[54] AUTOMATED LOW-PRESSURE CASTING MECHANISM AND METHOD

[75] Inventor: Günter Phillips, Cologne, Fed. Rep. of Germany

[73] Assignee: Russ-Elektroofen Produktionsgesellschaft mbH & Co., Cologne, Fed. Rep. of Germany

[21] Appl. No.: 216,276

[22] Filed: Dec. 15, 1980

[30] Foreign Application Priority Data

Dec. 15, 1979 [DE] Fed. Rep. of Germany ..... 2950597

[51] Int. Cl.[3] ..... B22C 11/04

[52] U.S. Cl. ..... 164/119; 164/113; 164/130; 164/136; 164/309; 164/326; 164/327

[58] Field of Search ..... 164/113, 119, 130, 135, 164/136, 309, 316, 317, 318, 325, 326, 327, 344

[56] References Cited

U.S. PATENT DOCUMENTS

| | | | |
|---|---|---|---|
| 1,078,446 | 11/1913 | Lewis . | |
| 1,219,358 | 3/1917 | Stewart . | |
| 1,403,955 | 1/1922 | Hill . | |
| 1,645,726 | 10/1927 | Vaughan . | |
| 1,663,693 | 3/1928 | Feltes . | |
| 1,722,414 | 7/1929 | Feltes . | |
| 2,015,975 | 10/1935 | Sulprizio . | |
| 2,070,649 | 2/1937 | Cox . | |
| 2,181,157 | 11/1939 | Smith . | |
| 2,254,295 | 9/1941 | Kohl . | |
| 2,487,703 | 11/1949 | Gougler | 164/342 |
| 2,496,130 | 1/1950 | Morin . | |
| 2,520,348 | 8/1950 | Tama . | |
| 2,527,537 | 10/1950 | Fahlman . | |
| 2,579,952 | 12/1951 | Morin . | |
| 2,711,568 | 6/1955 | Palmer . | |
| 2,947,045 | 8/1960 | Goldhamer . | |
| 2,965,938 | 12/1960 | Davis . | |
| 3,049,768 | 8/1962 | Powell . | |
| 3,273,210 | 9/1966 | Taccone | 164/344 |
| 3,283,374 | 11/1966 | Peras . | |
| 3,523,570 | 8/1970 | Groteke | 164/119 |
| 3,698,471 | 10/1972 | Chatourel | 164/340 |
| 3,765,474 | 10/1973 | Burton | 164/344 |
| 3,866,666 | 2/1975 | Wunder | 164/327 |

FOREIGN PATENT DOCUMENTS

| | | | |
|---|---|---|---|
| 2128425 | 1/1973 | Fed. Rep. of Germany . | |
| 2548215 | 5/1976 | Fed. Rep. of Germany . | |
| 2041588 | 9/1976 | Fed. Rep. of Germany . | |
| 2438060 | 11/1976 | Fed. Rep. of Germany . | |
| 45-7327050 | 10/1970 | Japan | 164/344 |
| 53-3076127 | 7/1978 | Japan | 164/309 |
| 360146 | 5/1975 | U.S.S.R. | 164/344 |

*Primary Examiner*—Gus T. Hampilos
*Assistant Examiner*—Richard K. Seidel
*Attorney, Agent, or Firm*—Penrose, Lucas, Albright, Mason, Mason & Albright

[57] ABSTRACT

A low pressure casting process using a furnace of the channel-type induction for heating, the furnace power being automatically controlled by direct temperature measuring of the molten metal bath according to the desired casting temperature. The feeding chamber of the furnace is of pressure-type and has a protective gas with a slight over-pressure. The furnace is filled via a syphon-shaped feeding chamber whereby metal is inserted below the level of molten metal in the feeding chamber and the protective gas therein is not affected. An operator starts the casting process whereby a casting mold is closed and assumes a casting position over the casting nozzle from the furnace and metal is forced into the mold. The mold, one of several on a carousel is moved to a station wherein the casting is automatically discharged to a conveyor belt. The mold next moves to an immersion bath where it is treated, and then to a preparation station wherein it may be cleaned and cores inserted. Finally, the mold returns to the casting station. Three such molds are shown which rotate simultaneously about a common axis of the carousel. The support for each mold permits the opening of the mold into mold halves for the immersion station and the tilting of the mold for the preparation station.

10 Claims, 14 Drawing Figures

AUTOMATED LOW-PRESSURE CASTING MECHANISM AND METHOD

SUMMARY OF THE INVENTION

The invention relates to an automatically controlled low-pressure casting process which is characterized by the following:

(a) In a casting station, the first of a number of casting molds (arranged at regular distances on a revolving table) is disposed at a known type of low-pressure furnace where it is filled with molten metal through the ascending pipe of the furnace. At the same time a second opened mold is submerged automatically at an immersion station in a treatment bath and is raised therefrom. Again at the same time, a third partially opened mold is prepared at a preparation station to perform the casting step at the next station which is the casting station. For example, cores may be inserted in the mold during this step.

(b) After the function of each station is performed the molds are revolved together on a revolving path until each reaches the next station where the various functions are repeated. However, the mold with the casting therein is automatically opened and emptied, after leaving the casting station and before reaching the immersion station, at a mold removal station. The mold upon leaving the treatment bath is tipped or tilted into a horizontal position. Each mold, after having been closed and prepared for the casting, is swung into a vertical position and lowered upon the furnace nozzle to receive molten metal.

(c) It is advantageous for the circular motion of all molds to be interrupted, as each mold, in turn, reaches the casting removal station whereby the immersion and preparation steps occur at the same time as the casting step.

(d) For the automatic removal of the cast pieces from the mold and to avoid injuring or otherwise blemishing the castings, opened molds are vibrated sufficiently to effect removal of the casting at the mold removal station.

The invention also relates to a mechanism for executing the above-described process characterized by revolving table which has arranged on its periphery at equal degrees of arc a number of similar (or in some cases different) casting molds supported by movable, turnable and extensible carrying devices for automatically opening and closing, tipping, raising and lowering the mold parts. Around the turntable, there are arranged a casting station with a known low-pressure furnace having an ascending pipe and furnace nozzle, an immersion station with a mold treatment bath, and a casting preparation station, as well as a casting removal station disposed between the furnace and the immersion bath. A driving gear or other appropriate driving device moves the molds from station to station and a control system is provided for automatically carrying out the various functions.

For adaptation to the automatic mode of operations, a known low-pressure casting furnace is preferably provided which includes a syphon-like filling chamber, the connection of which is, in the furnace's proportioning chamber, below the lowest surface level of the molten metal. By this means, an outflow of protective gas used as the pressure medium for casting is precluded during refilling the furnace with molten metal.

An important object of the invention is to provide an arrangement with an operational adaptability whereby automatic known manual casting processes can be performed completely or at least substantially, automatically, in a mechanism involving a series of casting molds arranged on a rotary casting machine which are filled one after the other with molten metal. Thus manual operations may be limited to tasks such as inserting mold cores, starting and stopping the mechanism and monitoring the mechanism's various evolutions.

For the filling molds moved on a circular path, a known low-pressure casting furnace (DEPS No. 2041588, DE-OS No. 2128425) is utilized with modifications adapted primarily for the automatic functioning of the invention.

Advantages of the invention involve not only the reduction of operational personnel, although in any event one person is still required for inserting cores and monitoring the installations, but also in the fact many manual operations may be eliminated which, in the conventional manual casting processes with rotary casting machines, were physically taxing, disagreeable and frequently dangerous, such as the manual handling of containers of the molten metal as well as annoyances of the accompanying noise, heat and gaseous emissions. Thus, the invention improves working conditions and environment substantially.

Further, the adaptation of the low-pressure casting process to automatic operations provides advantages in the control of filling molds, control of the casting to ensure adequate solidification, minimizing unneeded melting of the molten metal, reducing the time and expense required for melting the metal, improving the castings' quality, reducing foam or scum formation, minimizing risks of losing the protective gas atmosphere, and economizing the amount of metal invested in the inlet and delivery system.

Other objects, adaptabilities and capabilities of the invention will be appreciated by those skilled in the art as the description progresses, reference being had to the accompanying drawings, in which:

DESCRIPTION OF THE PREFERRED EMBODIMENTS

Figure 1:
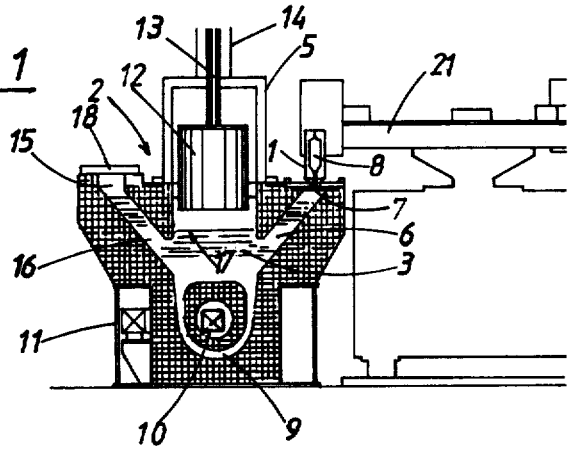
FIGS. 1 and 2 are simplified sectional views of the casting station of a device according to the invention with a low-pressure casting furnace and a mold on its outlet pipe.
Figure 2:
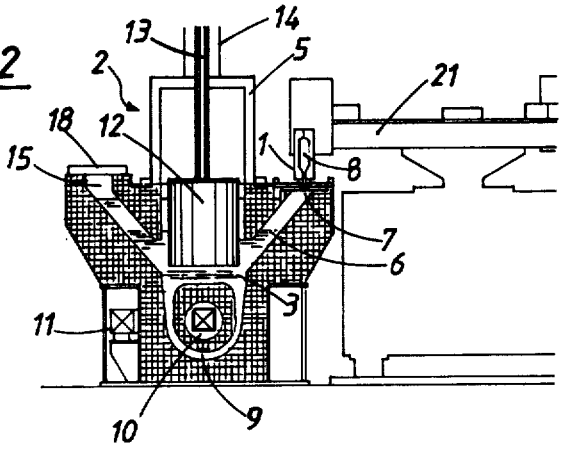

Referring to the Figures, an ingot mold 1, consisting of two halves 1*a* and 1*b*, is located in casting station G and in the closed vertical position, it is lowered onto the furnace nozzle of a low-pressure casting furnace 2. The latter is filled with molten metal 3 and includes, disposed above the molten metal surface 4, a cylindrical proportioning chamber 5 filled with a protective gas, for example, nitrogen.

By raising the pressure of the gas in chamber 5, mold 1 operates or causes molten metal surface 4 to lower and molten metal 3 to rise slowly through an ascending pipe 6 to a furnace nozzle 7 which can be one of several known nozzles, including a multiple nozzle, as required for the pieces to be cast in space 8. The parameters of casting speed and casting time for a bubble-free casting can, within the limitations of automatic control, be programmed for different molds by well-known techniques. Molten metal is thus introduced from pipe 6, through nozzle 7 into mold 8.

After expiration of the time required for solidification, the gas pressure in chamber 5 is reduced and the unsolidified metal in furnace nozzle 7 drops or falls into pipe 6 while at the same time molten metal surface 4 rises in chamber 5. Preferably, any protective gas removed from chamber 5 during this step is drawn without loss into a special container (not shown) for this purpose. When casting has been completed, mold 1 is automatically raised from furnace 2.

Preferably, the low pressure casting furnace 2 is an induction channel-type furnace with a melting or molten metal channel 9, a coil 10 and iron yoke 11. The smelting or melting space of furnace 2 is formed by proportioning chamber 5 above channel 9.

To maintain molten metal surface 4 at each casting at the same level and thus balance the metal used in the casting process, a displacement body 12 is provided, which is controlled by a rod 13 received in cylinder 14. The amount of displacement of body 12 in the molten metal 3 is controlled automatically in dependence on the volume of the cast piece.

After a certain number of castings, displacement body 12 reaches a predetermined lowest position which causes actuation of a signal which informs an operator that refilling of casting furnace 2 is required and, at the same time, causes displacement body 12 to return to its uppermost position. Furnace 2 is filled with fluid through a chamber 15 which has a connection 16 with proportioning chamber 5 which is below the lowest level 17 of molten metal 3. This prevents protective gas from escaping from proportioning chamber 5. Molten metal is introduced through chamber 15 until molten metal surface 4 reaches a height near and preferably under displacement body 12 in its highest position.

Figure 10:
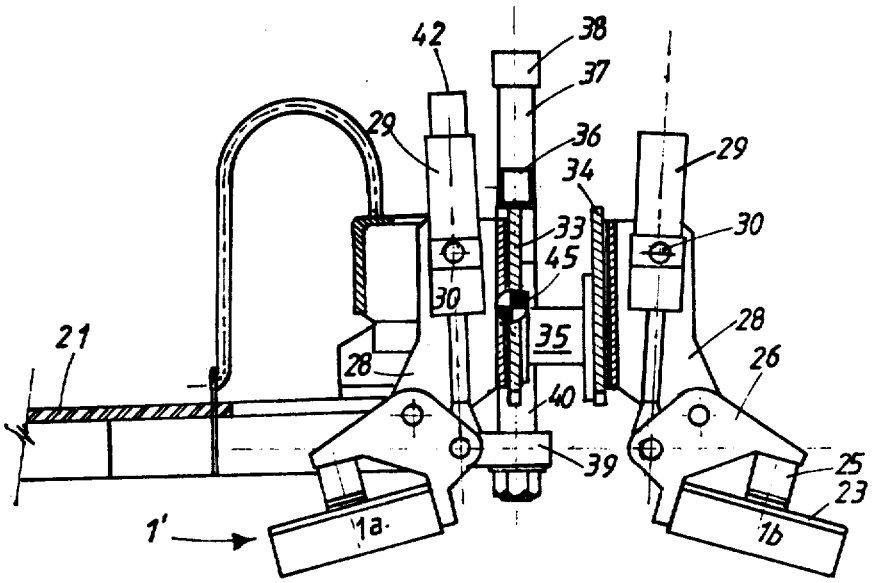
FIG. 10 corresponding to FIG. 8, illustrating the mold opened for ejection of a cast part.
Figure 11:
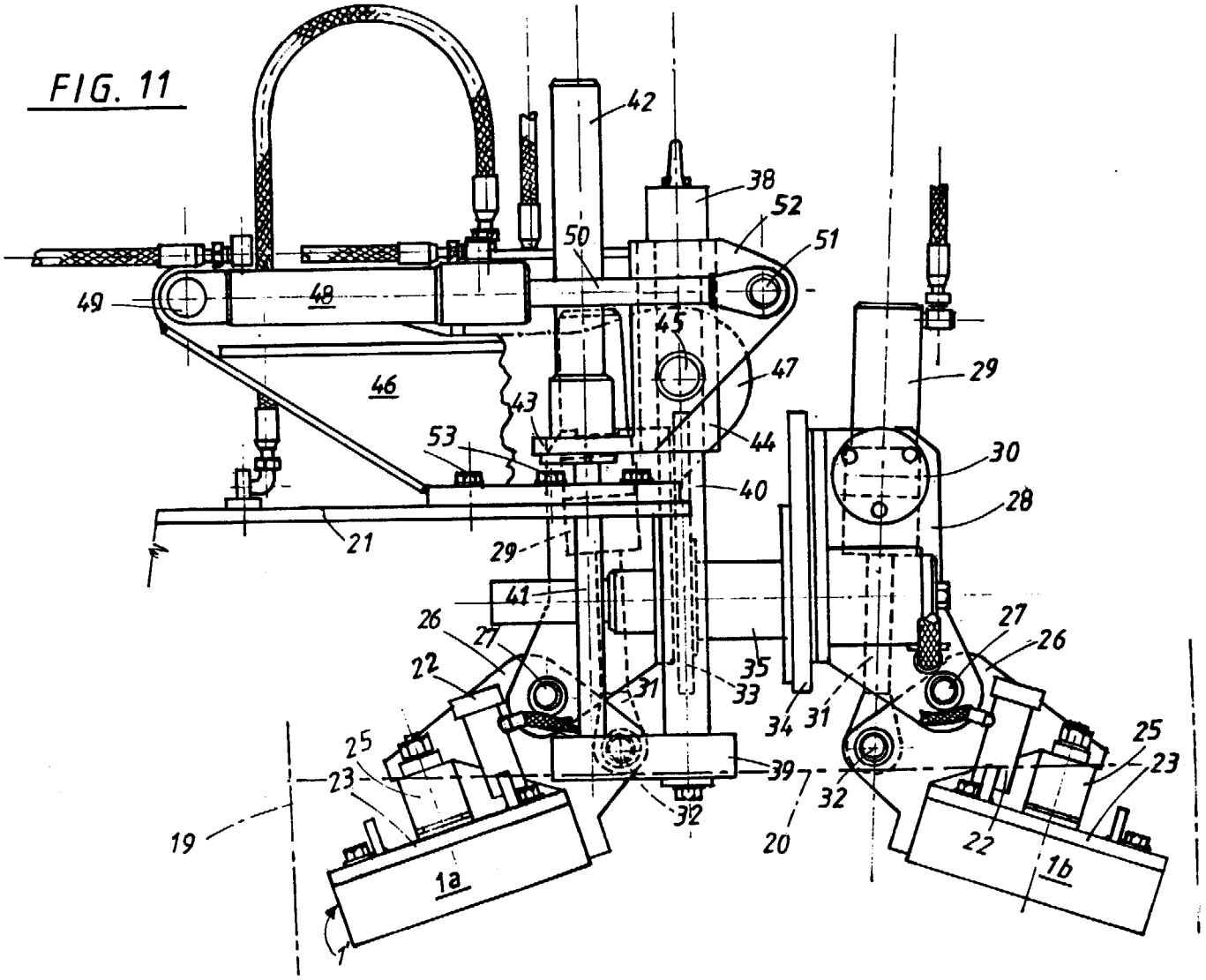
FIG. 11 is a side elevation of mold in the immersion position similar to FIG. 10 in an enlarged scale.

During the above-mentioned casting process, a second opened mold 1' is in at immersion station T, such mold having been lowered into a position as seen in FIG. 11 from a raised position represented in FIG. 10. Mold 1' is thus submerged in a treatment bath 20 contained in basin 19.

Bath 20, for example, a finishing or lubrication bath, is normally equipped with an agitator and preheated through a heating cartridge therein (neither being shown). The depth of the mold's submersion as well as its timing are preprogrammed, depending on the size of the mold so the temperature of the mold remains constant. Thereafter the mold is returned to the position shown in FIG. 10.

Figure 13:
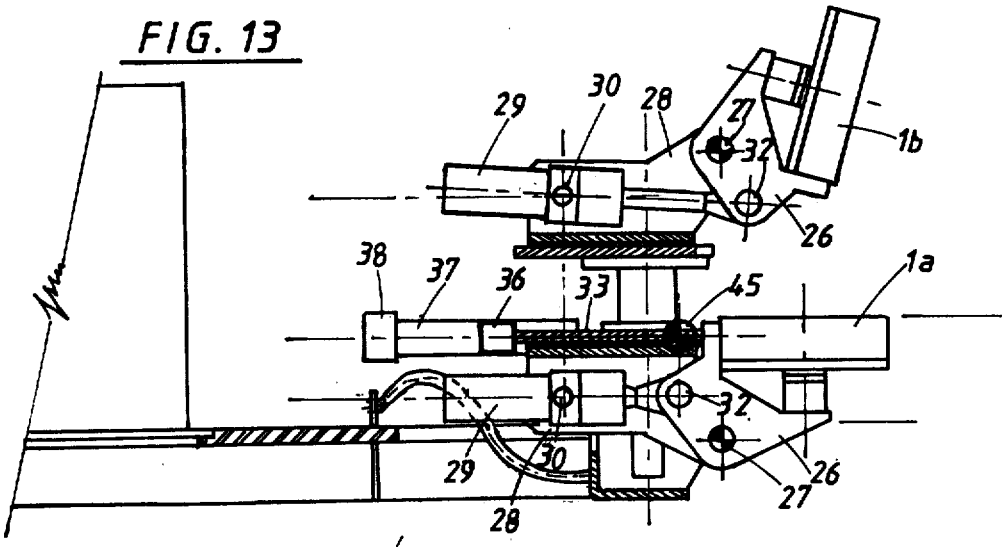
FIG. 13 illustrates molds corresponding to FIGS. 8 and 10 in the preparation station.

A third mold 1'' is, during the above-mentioned process, in a preparation station V in the partially opened position seen in FIG. 13, where an attendant monitors the automatic operational processes, cleans out the mold with compressed air as required, and inserts mold cores insofar as these steps are not performed automatically.

After completion of the third of the above-mentioned processes, which is of longest duration at which time the revolving table 21 carrying the molds is stopped, revolving table 21 is turned in the direction of arrow A and with it molds 1, 1' and 1'' are moved in a circular path until those following the three above-mentioned ingot molds have arrived in the described stations upon which the process is repeated.

Figure 3:
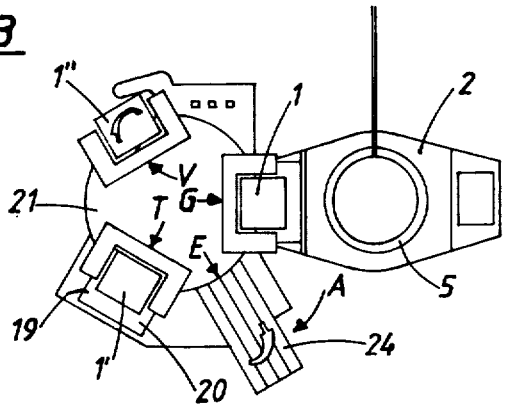
FIG. 3 is a plan view of a device according to the invention illustrating the arrangement of the casting mold removal, immersion and preparation stations.
Figure 4:
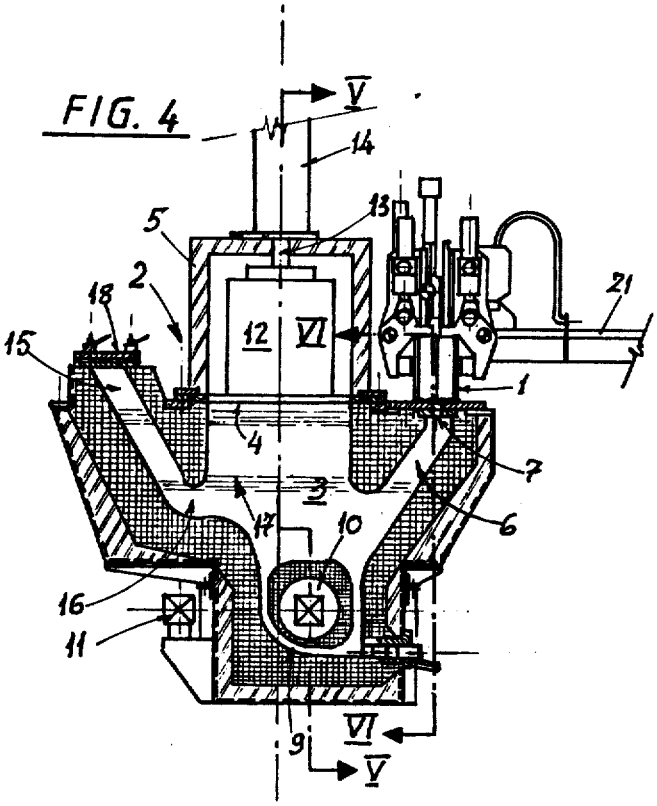
FIG. 4 is a sectional view corresponding to FIGS. 1 and 2 in somewhat larger scale with more details.
Figure 5:
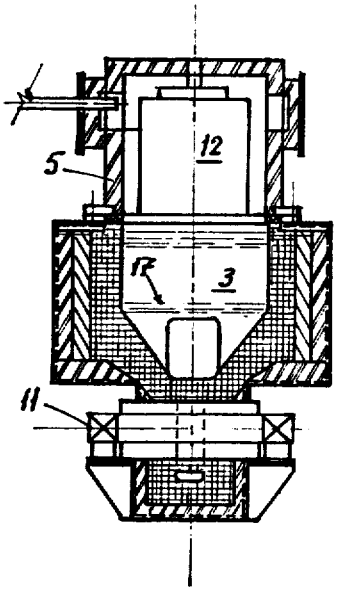
FIG. 5 is a sectional view taken on line V—V of FIG. 4.
Figure 6:
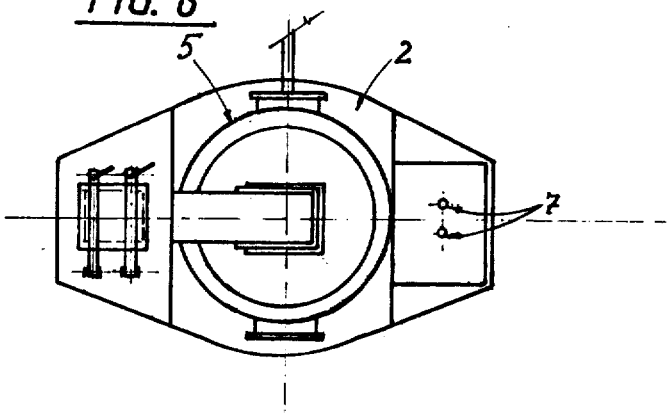
FIG. 6 is a sectional view taken on line VI—VI in FIG. 4.
Figure 7:
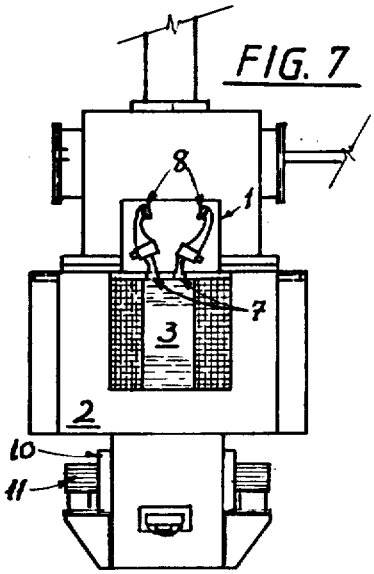
FIG. 7 is a plan view of the furnace of FIG. 4 with a multiple nozzle.

After leaving casting station G, mold 1 is opened and its casting is dislodged therefrom at separation station E before reaching immersion station T (FIG. 3). At station E, mold 1 is placed in the separated disposition shown in FIG. 10. Mold 1' leaves the finishing or lubrication bath and is brought, half-opened, into the horizontal position during this movement on a circular path as seen in FIG. 13, while the third mold 1'' is closed, disposed vertically, and lowered, upon reaching casting station G, onto nozzle 7.

To avoid marks or blemishes on the upper surfaces of finished cast pieces, which for example, are produced by conventional ejector pins, the ejection of the cast pieces from the molds is caused by subjecting the opened ingot mold at mold separation station E to vibration. For this purpose, a compressed air vibrator 22 is provided on clamping plates 23 (FIG. 11), on which mold halves 1*a* and 1*b* are fastened by bolts or other suitable fastening means.

The cast pieces removed from the molds fall onto a conveyor belt 24 (FIG. 3). Conveyor belt 24 moves the cast pieces along a cooling line in the direction of an intercepting container. It is controlled to be switched automatically after ejection of each cast piece and the cast pieces are conveyed in a timed manner to the intercepting container. In this connection, the conveying process is preferably adjustable to operational conditions selectively to control the period of cooling and to provide an attendant the capability of controlling the speed and direction of conveyor belt 24.

To ensure castings are dislodged onto conveyor belt 24 it frequently is desirable to stop the molds for a short period at station E and there is thus an advantage to providing equal arcs of movement of turntable 21 between stations E, T, V and G of 90° than simply between stations G, T and V of 120°, as shown in FIG. 3.

Where a longer solidification time after casting, in the closed mold 1, is desired, the arc of movement between stations G and E may be increased whereby station E is nearer station T.

Five or seven molds, or a multiple thereof, may be employed whereby the cooling of the coating while in the mold may be prolonged through several "station stops." On the other hand, it is conceivable to use only two ingot molds, placed diametrically opposite each other, especially if stopping of the turntable in neither in preparation station V nor mold removal station E is required or the period the table is stopped in these stations is extraordinarily short.

If desired, automatic control of the process may be programmed to end when a selected ingot mold arrives in the preparation station where it must be started again by the attendant. Alternatively, it can be programmed to operate, after starting, in a fully automatic fashion with pre-programmed stoppages in the above-mentioned stations until interrupted by the attendant or automatically because of an interruption instruction.

Figure 12:
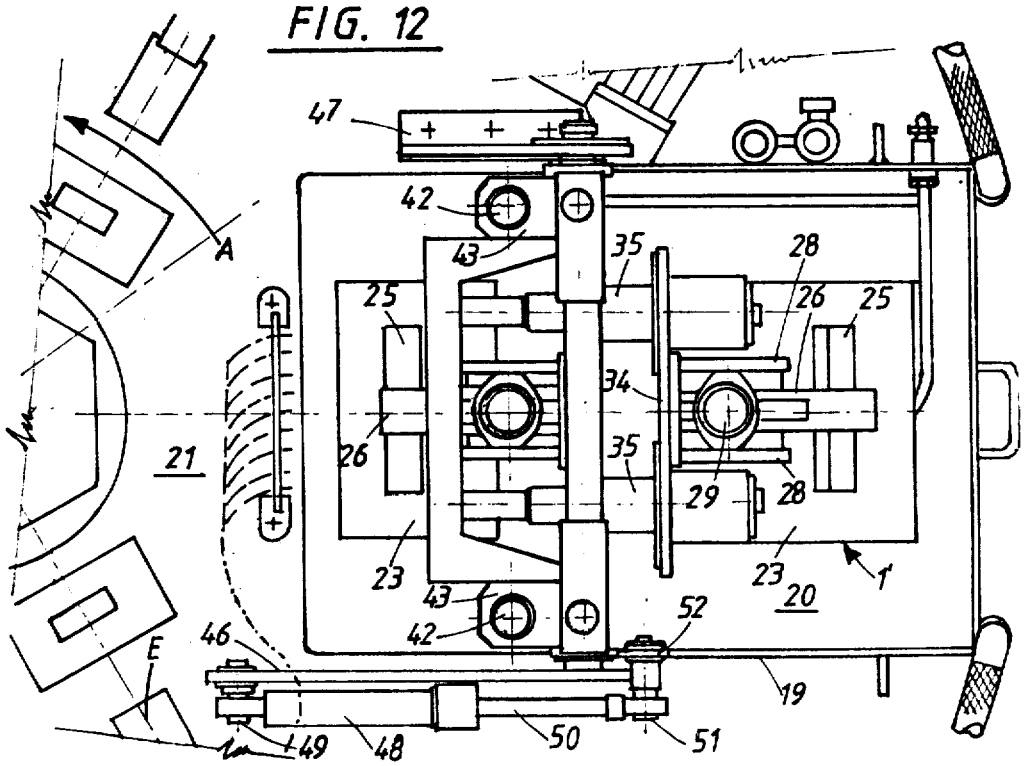
FIG. 12 is a plan view of the immersion station.

As should be readily understood from the above description of the device's operations, individual molds carry out opening, closing, tipping or tilting as well as raising and lowering motions, which are obtainable by electrically or electronically programmed pneumatic or hydraulic systems. The technical specifics of such controls are not objects of the present invention and are well within the skill of those who practice the various arts involved. Nevertheless, the above-mentioned operations are accomplished through the following described arrangements with particular reference to FIGS. 11, 12 and 14.

As previously described, both mold halves 1*a* and 1*b* are fastened to clamping plates 23 onto which the above-described compressed air vibrator 22 is also secured. Clamping plates 23 are connected by bars 25 to closing plates 26 which, with the assistance of pins 27, are pivotally connected to bearing plates 28.

Figure 8:
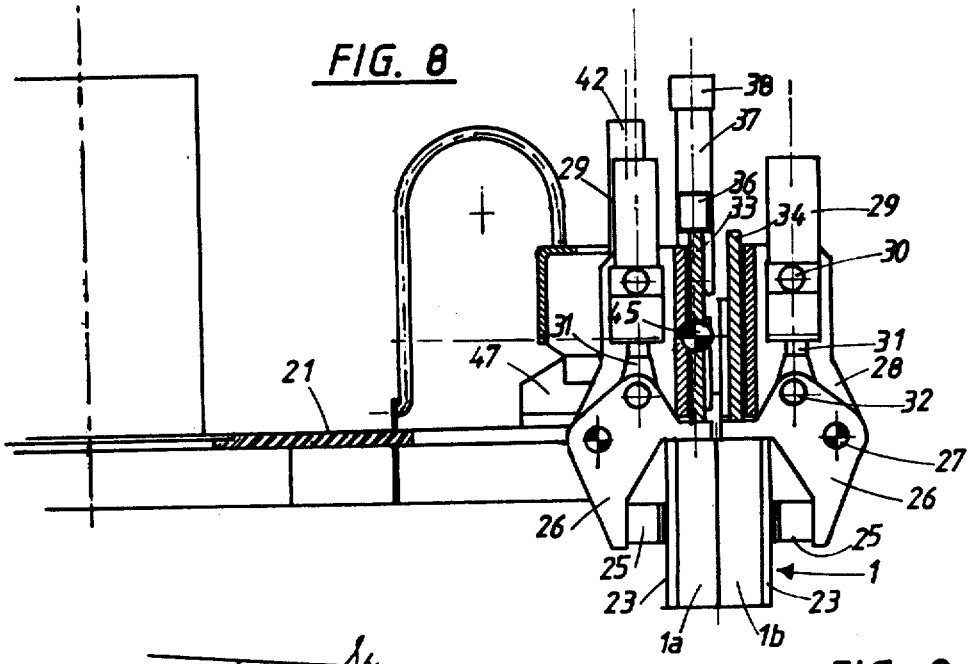
FIG. 8 illustrates in partial section the arrangement of molds in the casting position.
Figure 9:
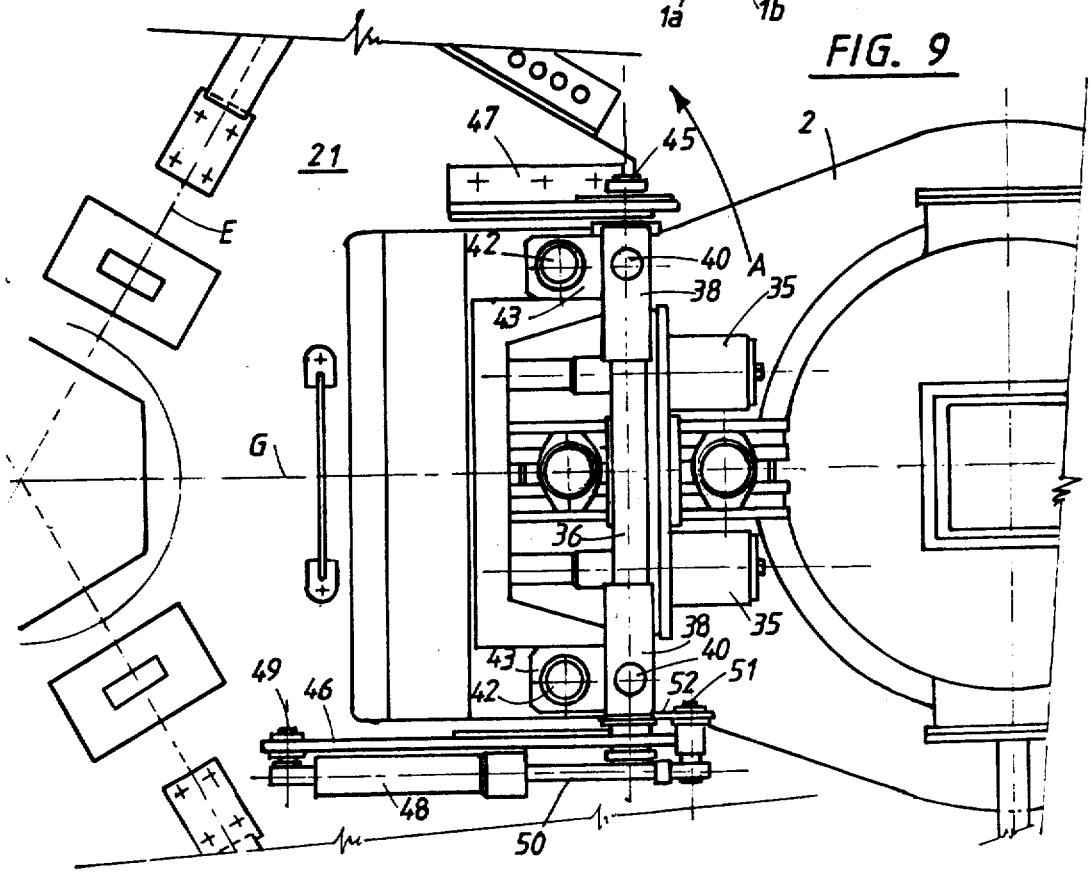
FIG. 9 is a plan view of the arrangement shown in FIG. 8.

Closing cylinders 29 are also connected to bearing plates 28 whereby they are movable in swing bearings or trunnions 30. The ends of piston rods 31 received in cylinders 29 are journalled by pins 32 to closing plates 26. The outward motion of piston rods 31 of closing cylinders 29 causes an arcuate movement of closing plates 26, and therewith of mold halves 1*a* and 1*b*, around pins 27 to the opened position represented in FIGS. 10 and 11, whereas inward motion of piston rods 31 causes a return arcuate movement of mold halves 1*a* and 1*b* back to into the closed position represented in FIG. 8. In FIG. 13, it will be noted piston rod 31 of the piston and cylinder assembly 29 has its piston withdrawn into the lower closing cylinder 29 and piston rod 31 is extended from the upper closing cylinder 29. Thus, in this Figure, one mold half, 1*a*, is in its closed position and the other mold half 1*b* in its opened position.

Although the above described arcuate motion of mold halves 1*a* and 1*b* is sufficient to open and to close mold 1, and thus permit the steps of casting, mold removal, and immersion (with a subsequently later described lowering motion) it is especially advantageous that at preparation station V shown in FIGS. 13 and 14, the mold halves 1*a* and 1*b* can be controlled independently and placed in the separated relationship illustrated in FIG. 13. For this purpose each bearing plate 28 has connected thereto a support plate 33 and 34, respectively, arranged one to each mold half 1*a* and 1*b*. Plates 33 and 34 are connected with each other through a pair of telescoping cylinders 35 by which plates 33 and 34 and with them the closure system of the mold halves 1*a* and 1*b* can be moved together and apart.

As previously set forth, it is necessary for placing the molds on furnace nozzles 7 as well as for their immersion into the treatment bath to provide the capacity to raise or lower such molds. For this purpose, support plate 33 is connected to frame parts 36 and 37, which by means of frame parts 38 connects with angle plates 39. The lower ends of guide cross beams 40 are, in turn, connected with angle plates 39. The outer ends of piston rods 41 bear upon angle plates 39, such rods extending from hydraulic lowering cylinders 42 which are fastened on brackets 42 which project from guidance blocks 44 which receive and guide cross beams 40. An outward motion of the piston rods 41 thus causes the lowering of angle plates 39 and of cross beams 40, which are guided by guidance blocks 44. This motion causes, via angle plates 39 and frame parts 36, 37 and 38, the lowering of support plate 33 and mold half 1*a* connected with it. At the same time, support plate 34, carried by telescoping cylinders 35, and mold half 1*b* connected thereto, are similarly lowered.

Figure 14:
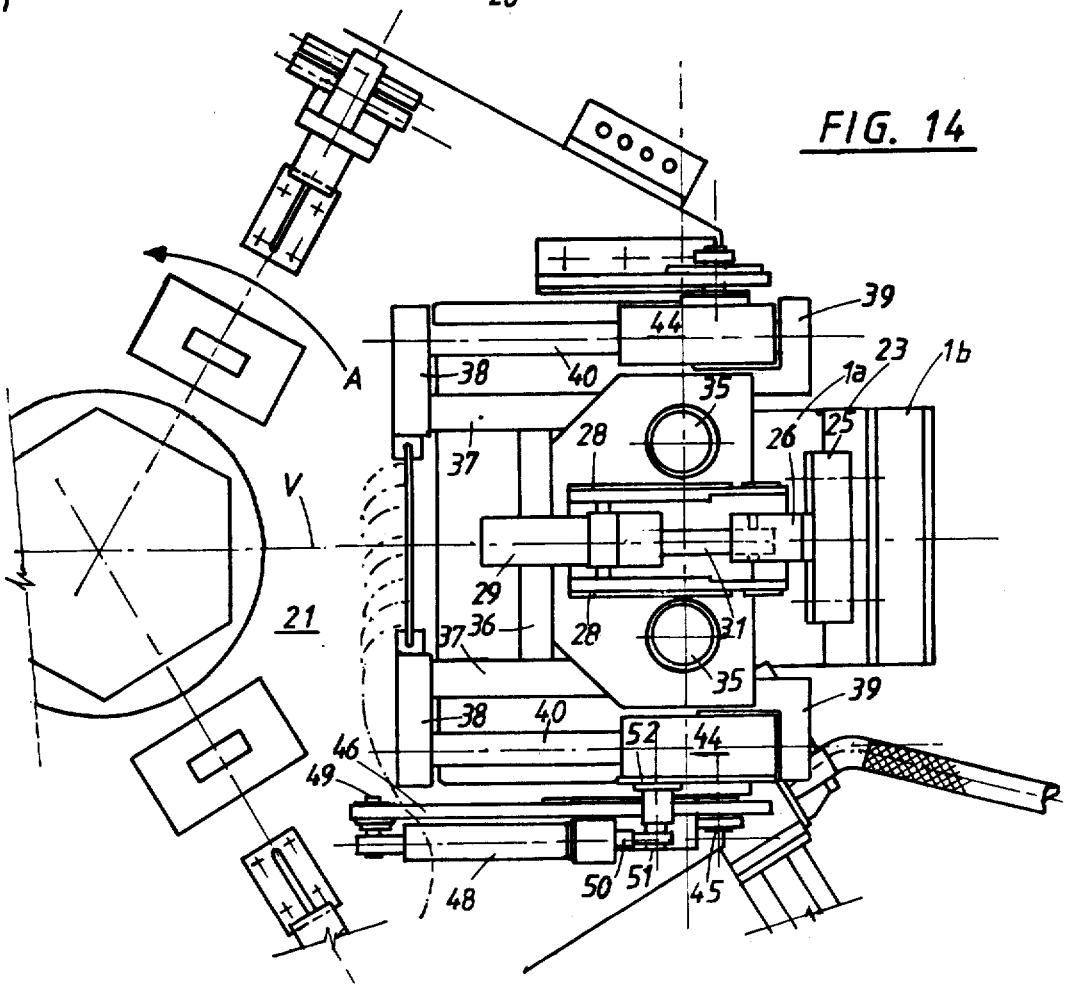
FIG. 14 is a plan view of the preparation station.

Bearing pins 45 pivotally connect guidance blocks 44 to supports 46 and 47 whereby blocks 44 together with beams 40 and the above-described system may be tilted from the vertical into the horizontal position as represented in FIGS. 13 and 14. To accomplish this, a swinging cylinder and piston assembly 48 and 50 has its cylinder's outer end fastened by a pin 49 to support 46 while its piston rod 50 is adapted to move in an arc, through a pin 51, a swinging plate 52 which is rigidly connected with one of the guidance blocks 44. Supports 46 and 47 are firmly secured to revolving table 21 by means of bolts 53.

Control of the above-mentioned working or operational cylinders results, as alredy indicated, from pneumatic or hydraulic systems through valves controlled by electrical or electronic arrangements well within the skill of the art.

A casting mechanism in accordance with the foregoing description is capable of producing up to 180 castings per hour per mold. It has been found that the average mold insertion time is approximately ten seconds, the average casting and solidification period is also approximately 10 seconds and the circuit time for each of the three mold stations is approximately 10 to 13 seconds for each casting operation. Thus, with three molds in the mechanism, a casting cycle of about 20 to 23 seconds is possible which provides the maximum output of up to about 540 castings per hour. The type of furnace used in practice has a capacity of about 600 kilograms. Brass is a typical metal used in the type of furnace involved.

The drawings, although simplified and not exactly to dimension, nevertheless disclose the general relationship of the various components of the invention. The turntable or carousel is preferably driven by a gear arrangement and its various starts and stops as well as other operations are easily achieved through timed rotation of switch contacts as found on many types of apparatus to control sequential processes such as, for example, household washers and dryers. Digital and other types of programming is also possible and it is considered that a detailed disclosure of this aspect of the mechanism is so well understood that its specific disclosure herein would only serve to lengthen and confuse to a certain degree the specification in an undue manner.

It will also be appreciated that although preferred embodiments of the invention are described above, the invention is capable of other adaptations and modifications within the scope of the following claims.

Having disclosed my invention, what I claim as new and desire to be secured by Letters Patent of the United States is:

1. An automatically controlled low-pressure casting process characterized by the combination of the steps:

A. Introducing in a casting station the first of a plurality of molds which are arranged spaced apart about the periphery of a revolving table;

B. Lowering said mold, which has previously been closed, onto the furnace nozzle of a low pressure casting furnace comprising a proportioning chamber filled with a protective gas;

C. Raising the pressure of said protective gas, thereby causing molten metal to rise through an ascending pipe of said furnace and said furnace nozzle and to fill said closed mold;

D. Lowering the pressure of said protective gas thereby returning surplus metal within said furnace nozzle and said ascending pipe into said furnace, and raising said mold to its initial position;

E. Simultaneously submerging and removing a second mold, which has been opened and disposed to a substantially horizontal position of its mold halves, in and from a treating bath at an immersion station;

F. Also simultaneously preparing a third mold in a preparation station for casting subsequent to tilting a mold support means into a horizontal disposition and arcuately moving one of said mold halves into a horizontal disposition;

G. Turning said molds, opening said first mold and removing said casting therein before said first mold reaches said immersion station;

H. Closing said third mold and tilting said mold support means back into a vertical disposition after finishing the preparation of said mold; and I. Continuing to turn said molds on a circular path until each said mold has reached the next of said stations whereupon the aforesaid steps are repeated.

2. A process according to claim 1, wherein the motion of the molds is interrupted on the circular path when one mold is at said casting removal station, said station located between said casting station and said immersion station.

3. A process according to claim 1, wherein said mold at said mold removal station is vibrated.

4. A mechanism for the automatic operation of a low-pressure casting process comprising a revolving table, a plurality of casting molds equidistantly disposed on the periphery of said table, each of said molds comprising two mold halves; closing means being provided for the arcuate and further means for the linear movement of said mold halves towards and away from each other; lowering means being provided in conjunction with each of said molds for lowering and raising and mold support means for tilting said molds from a vertical to a horizontal disposition and vice versa; said revolving table having arranged around it a casting station with a low pressure casting furnace including an ascending pipe and a furnace nozzle for filling each said mold with molten metal, an immersion station including a mold treatment bath, and a casting preparation station for said molds, a casting removal station being provided between said casting station and said immersion station, a mechanism for moving the ingot molds from said station to the next said station, and means for causing selected of said automatic functions to occur at each said station.

5. A mechanism according to claim 4, wherein said low-pressure casting furnace comprises a filling chamber, a syphon-like connection and is provided with a proportioning chamber, said filling chamber leading via said syphon-like connection to the lower part of said proportioning chamber.

6. A device according to claim 1, wherein said furnace nozzle comprises multiple nozzles.

7. A device according to claim 1, wherein said treatment bath comprises a finishing bath and said immersion station is provided with an agitator.

8. A device according to claim 7, wherein said immersion station is provided with heating means adapted to maintain said treatment bath at a constant temperature.

9. A device according to claim 1, wherein said casting removal station comprises a conveyor belt for automatically removing said castings.

10. A mechanism according to claim 1, wherein a compressed air vibrator being is provided on each said mold half as the sole means for removing the casting therefrom.

* * * * *